US007954804B2

(12) United States Patent
Uchida et al.

(10) Patent No.: US 7,954,804 B2
(45) Date of Patent: Jun. 7, 2011

(54) RECORDING APPARATUS

(75) Inventors: Haruo Uchida, Yokohama (JP); Kenji Kawazoe, Yokohama (JP); Nozomu Nishiberi, Yokohama (JP); Koichiro Kawaguchi, Yokohama (JP); Yoshiaki Watanabe, Tokyo (JP); Yasuyuki Asai, Tokyo (JP); Mitsuru Kondo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 683 days.

(21) Appl. No.: 12/107,699

(22) Filed: Apr. 22, 2008

(65) Prior Publication Data

US 2008/0265481 A1 Oct. 30, 2008

(30) Foreign Application Priority Data

Apr. 27, 2007 (JP) ..... 2007-118064

(51) Int. Cl.
*B65H 3/44* (2006.01)
*B65H 5/26* (2006.01)

(52) U.S. Cl. ..... 271/9.12; 400/584

(58) Field of Classification Search ..... 271/3.14, 271/3.18, 3.2, 4.01, 4.03, 4.08, 4.1, 9.01, 271/9.02, 9.04, 9.05, 9.07, 9.12, 9.13, 314; 400/584, 605, 607, 607.1, 624, 629; 270/18
See application file for complete search history.

(56) References Cited

U.S. PATENT DOCUMENTS

| | | | | | |
|---|---|---|---|---|---|
| 1,563,800 | A | * | 12/1925 | Smith | 400/610.2 |
| 4,855,794 | A | * | 8/1989 | Suzuki | 355/54 |
| 5,199,695 | A | * | 4/1993 | Nakahata et al. | 271/9.12 |
| 5,405,129 | A | * | 4/1995 | Mihara et al. | 271/111 |
| 5,433,425 | A | * | 7/1995 | Kubota et al. | 271/9.12 |
| 7,731,350 | B2 | * | 6/2010 | Yamamoto | 347/104 |

FOREIGN PATENT DOCUMENTS

| | | | |
|---|---|---|---|
| JP | 6077040 | * | 5/1985 |
| JP | 6183586 | * | 7/1994 |
| JP | 9-109491 | | 4/1997 |
| JP | 2004-195840 | | 7/2004 |

* cited by examiner

*Primary Examiner* — David H Bollinger
(74) *Attorney, Agent, or Firm* — Canon USA Inc IP Division

(57) ABSTRACT

A recording apparatus includes moving rollers and a feeding roller. The moving rollers move a set first sheet in a direction intersecting a conveying direction. The feeding roller conveys sheets at a sheet stacking portion. After the first sheet is shifted to a parallel position by the moving roller, a second sheet at a setting position and the first sheet at the parallel position are conveyed by the feeding roller.

9 Claims, 19 Drawing Sheets

RECORDING APPARATUS

BACKGROUND OF THE INVENTION

1. Field of the Invention

The present invention relates to a recording apparatus that performs a recording operation on a sheet by using a recording head.

2. Description of the Related Art

A recording apparatus that performs a recording operation on a sheet by using a recording head is widely used as an output apparatus of a processing system or an information processing apparatus. As sheet conveying mechanisms in recording apparatuses, structures for simultaneously performing recording operations on two sheets are discussed in Japanese Patent Laid-Open Nos. 9-109491 and 2004-195840. In each of these related sheet conveying mechanisms, two sheets that are placed at positions that are parallel to each other are conveyed at the same time, and recording operations are simultaneously performed on the two sheets at a recording portion. Then, the sheets that are parallel to each other are ejected at the same time. By such a structure, it is possible to reduce recording time by increasing recording speed when performing recording operations on sheets having various sizes.

However, the above-described related examples have a problem in that a user must set the sheets at two positions that are parallel to each other. Setting the sheets at two separate positions may cause the sheets to be improperly or unsuccessfully set. In the related examples, if the sheets that are placed at the two positions are not equally divided, the user cannot tell which of the two positions runs out of sheets first. Therefore, absence or presence of sheets must be detected at both positions, thereby complicating controlling operations. Consequently, costs are increased. In addition, in the related examples, the recorded sheets are ejected in parallel. Therefore, when many sheets are continuously recorded, the order of pages must be corrected after ejecting the sheets. As a result, the processing operations become troublesome compared to those in an ordinary recording operation.

SUMMARY OF THE INVENTION

The present invention provides a recording apparatus that can reduce recording time and increase operational performance.

According to an aspect of the present invention, a recording apparatus that performs recording operations on sheets by a recording head is provided. The recording apparatus includes a sheet stacking portion having a setting position where the sheets are stacked, a moving roller that moves a first sheet of the sheets that is stacked at the setting position, in a direction intersecting a conveying direction, and a feeding roller that conveys the sheets at the sheet stacking portion. In the recording apparatus, after the first sheet that is stacked at the setting position is moved by the moving roller to a parallel position, the first sheet at the parallel position and a second sheet of the sheets at the setting position are conveyed by the feeding roller. The parallel position is set in the direction intersecting the conveying direction.

Further features of the present invention will become apparent from the following description of exemplary embodiments with reference to the attached drawings.

DESCRIPTION OF THE EMBODIMENTS

First Exemplary Embodiment

Figure 1:
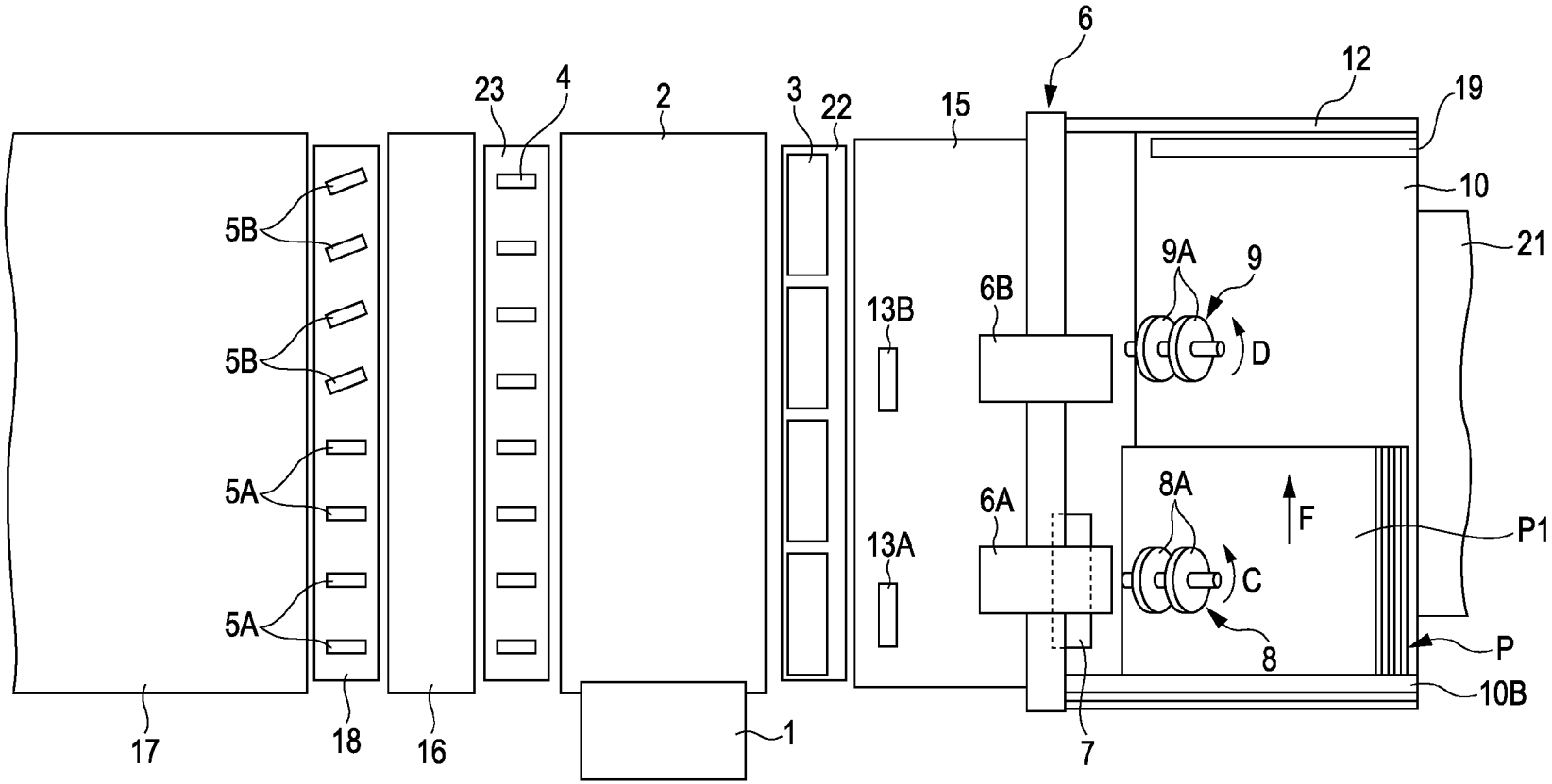
FIG. 1 is a plan view when sheets are set on a sheet-stacking portion in a recording apparatus according to an embodiment of the present invention.
Figure 2:
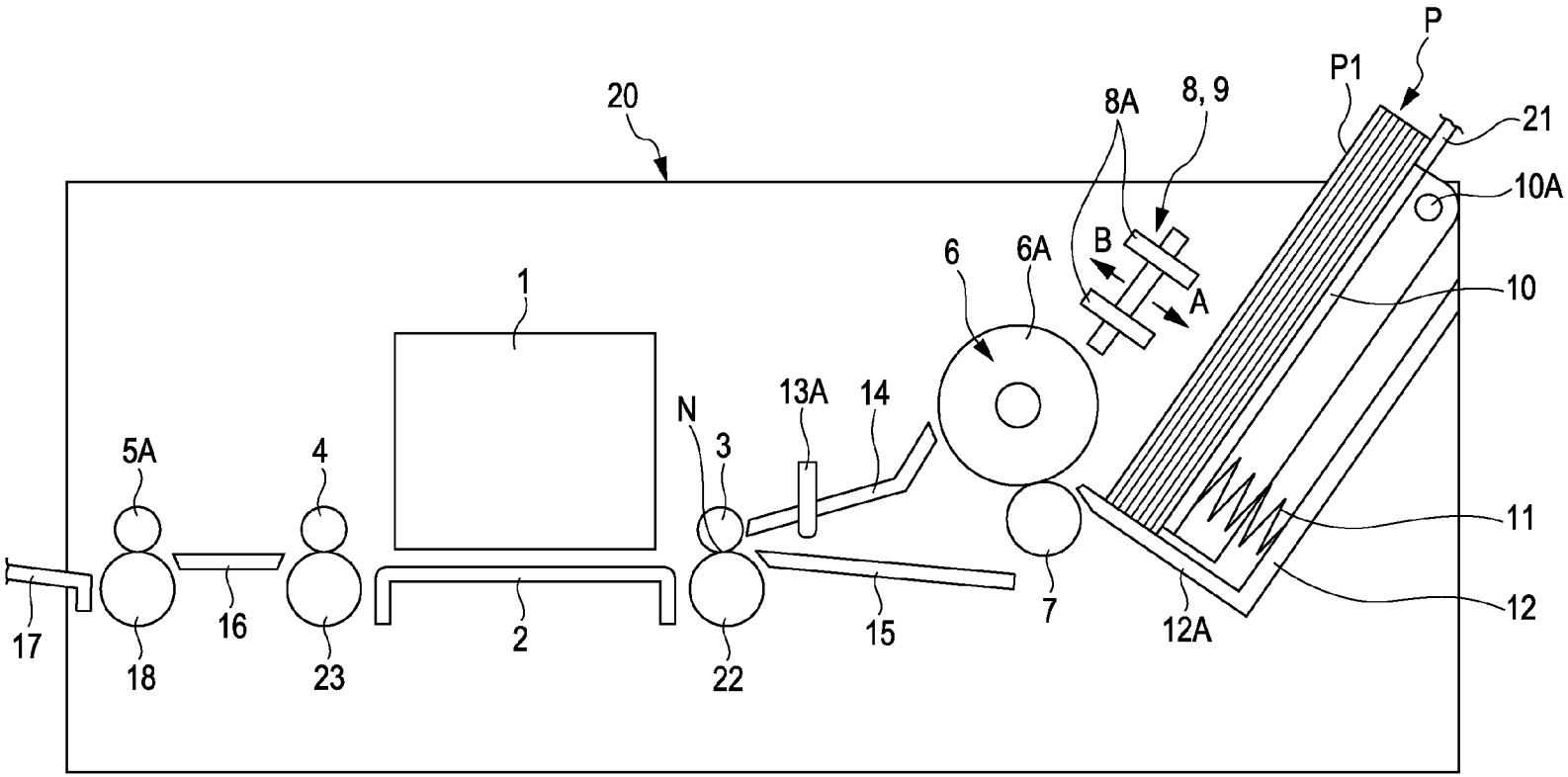
FIG. 2 is a vertical sectional view of the recording apparatus shown in FIG. 1.
Figure 3:
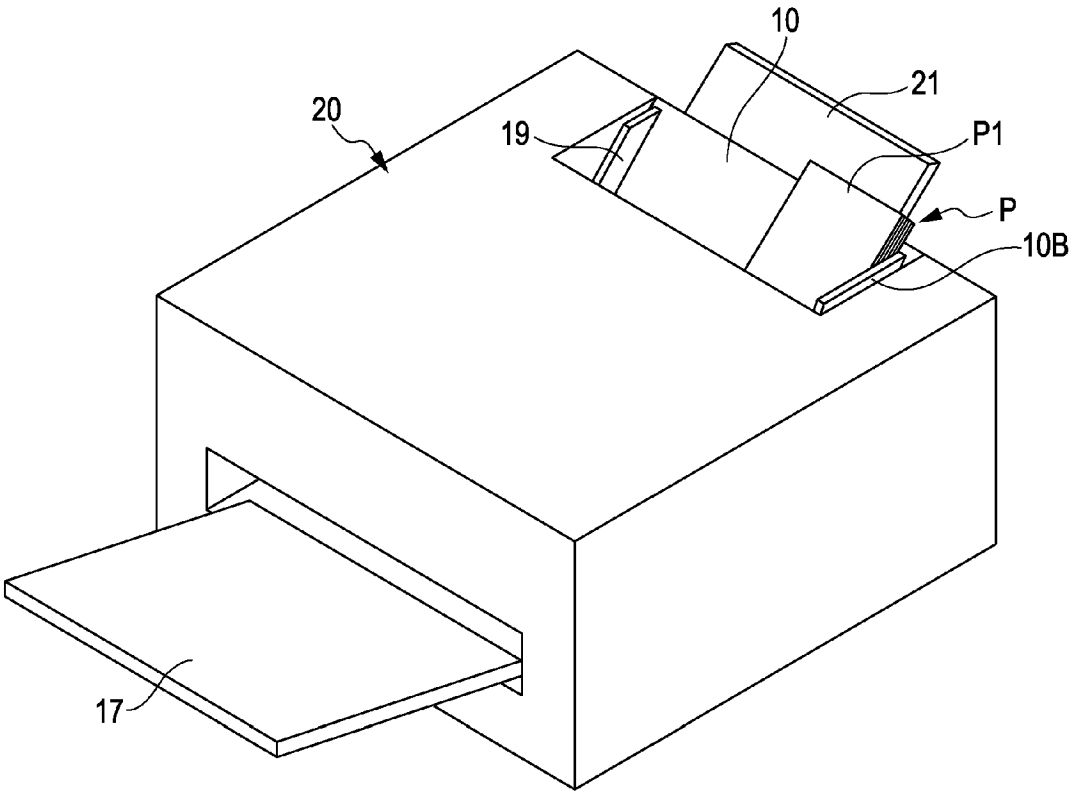
FIG. 3 is a perspective view of the recording apparatus shown in FIG. 1.

An exemplary embodiment of the present invention will now be described in detail with reference to the drawings. In the figures, the same reference numerals will be given to the same or corresponding parts. FIG. 1 is a plan view when sheets are set on a sheet-stacking portion in a recording apparatus according to one embodiment of the present invention. FIG. 2 is a vertical sectional view of the recording apparatus shown in FIG. 1. FIG. 3 is a perspective view of the recording apparatus shown in FIG. 1. In the exemplary embodiment below, an inkjet recording apparatus is used. In FIGS. 1 to 3, a recording portion that forms images on sheets P is provided with a recording head 1 and a platen 2. The recording head 1 performs recording operations as a result of selectively ejecting ink onto the sheets P from a plurality of ejection ports on the basis of recording information. The recording head 1 is carried by a carriage (not shown), and moves in a direction that intersects (usually, that is perpendicular to) a sheet conveying direction to perform the recording operations on the sheets. The platen 2 is disposed so as to oppose the recording head 1, and supports the sheets that are to be conveyed to the recording portion.

A sheet-feeding portion for supplying the sheets P to the recording portion is provided with a pressure plate 10 that constitutes the sheet-stacking portion for stacking the sheets P thereon. The pressure plate 10 is mounted to a base 12 of the sheet-feeding portion so as to be rotatable around a fulcrum 10A as center, and is biased towards a feeding roller 6 by a spring 11. When a sheet is being conveyed, the pressure plate 10 operates so as to press the sheet against the feeding roller 6 by the spring 11. A sheet-feed tray 21 that can be expanded and compressed for supporting large sheets is mounted to the pressure plate 10. The stacked sheets P are held at a setting position while front edges thereof abut against a positioning face 12A of the base 12. In the feeding roller 6, a first roller portion 6A and a second roller portion 6B are integrally provided with each other. The first roller portion 6A is used for separating and conveying the sheets that are stacked at the setting position. The second roller portion 6B is used for conveying the sheet that is shifted to a parallel position (described later). A separating roller 7 presses against the first roller portion 6A, and is used to separate and send out the sheets one at a time. A torque limiter (not shown) is built in the separating roller 7. The torque limiter rotates when a load torque exceeds a predetermined value, to separate the sheets.

A first moving roller 8 and a second moving roller 9 are provided above the sheets stacked on the pressure plate 10, and are used for moving a first sheet P1 that is stacked at the setting position, in the direction that intersects (usually, that is perpendicular to) the conveying direction. The first moving roller 8 is provided for sending out the sheet at the setting position towards the parallel position. The second moving roller 9 is provided for shifting the sent-out sheet up to the parallel position. The first moving roller 8 and the second moving roller 9 having roller portions 8A and roller portions 9A, respectively, are mounted so that the respective roller portions 8A and 9A can individually press-contact and separate from the sheets on the sheet-stacking portion. When the roller portions 8A and the roller portions 9A press-contact the sheets, movement of the sheets can be controlled. In the embodiment, the first moving roller 8 and the second moving roller 9 are rotatably mounted at, for example, a securing portion of the base 12.

A feeding roller 22 for conveying the sheets P is disposed upstream from the recording portion in the sheet conveying direction. A pinch roller 3 for applying a conveying force presses against the feeding roller 22, to form a nip portion N between the feeding roller 22 and the pinch roller 3. The sheet P that is conveyed from the feeding roller 6 is guided up to the nip portion N through an upper sheet guide 14 and a lower sheet guide 15. A sheet edge sensor 13A and a sheet edge sensor 13B for detecting front and rear edges of the sheets are disposed upstream from the feeding roller 22 in the conveying direction. The two sensors 13A and 13B are disposed for detecting the edges of two sheets that are conveyed at the same time for simultaneous recording (described later). The sensors 13A and 13B may be, for example, lever sensors or photo-interrupters.

A first eject roller 23 is disposed downstream from the recording portion in the sheet conveying direction. A second eject roller 18 is disposed downstream from the first eject roller 23 in the sheet conveying direction. A sheet guide 16 is disposed between the first eject roller 23 and the second eject roller 18. The first eject roller 23 conveys the sheets for performing recording operations on the sheets, and ejects the sheets. The second eject roller 18 ejects the sheets. A spur 4 presses against the first eject roller 23. Spurs 5A and spurs 5B press against the second eject roller 18. The spurs 5A are provided for ejecting the sheet at the setting position side when performing simultaneous recording. The spurs 5B are provided for ejecting the sheet at the parallel position side. As shown in FIG. 1, the spurs 5B are obliquely disposed for obliquely conveying the sheet at the parallel position side towards the setting position. The obliquely disposed spurs 5B and the second eject roller 18 can convey the sheet at the parallel position side towards the setting position. As the spurs 4, 5A, and 5B, spurs having uneven, metallic portions that contact the sheet may be used. The ejected sheet is stacked upon an eject tray 17. Reference numeral 20 denotes the entire body of the apparatus.

Figure 4:
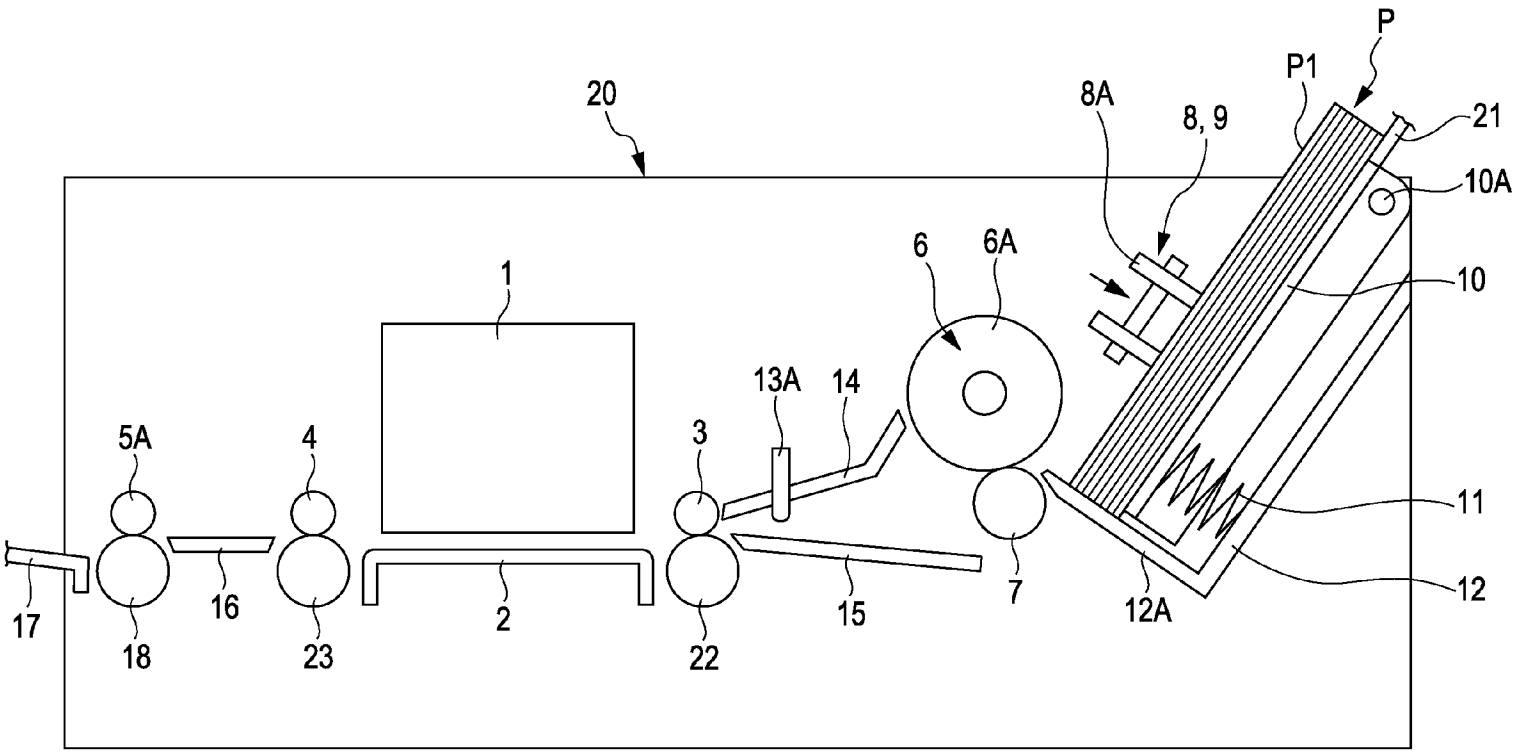
FIG. 4 is a vertical sectional view when moving rollers are pressed against the sheets that are stacked on the sheet-stacking portion.
Figure 5:
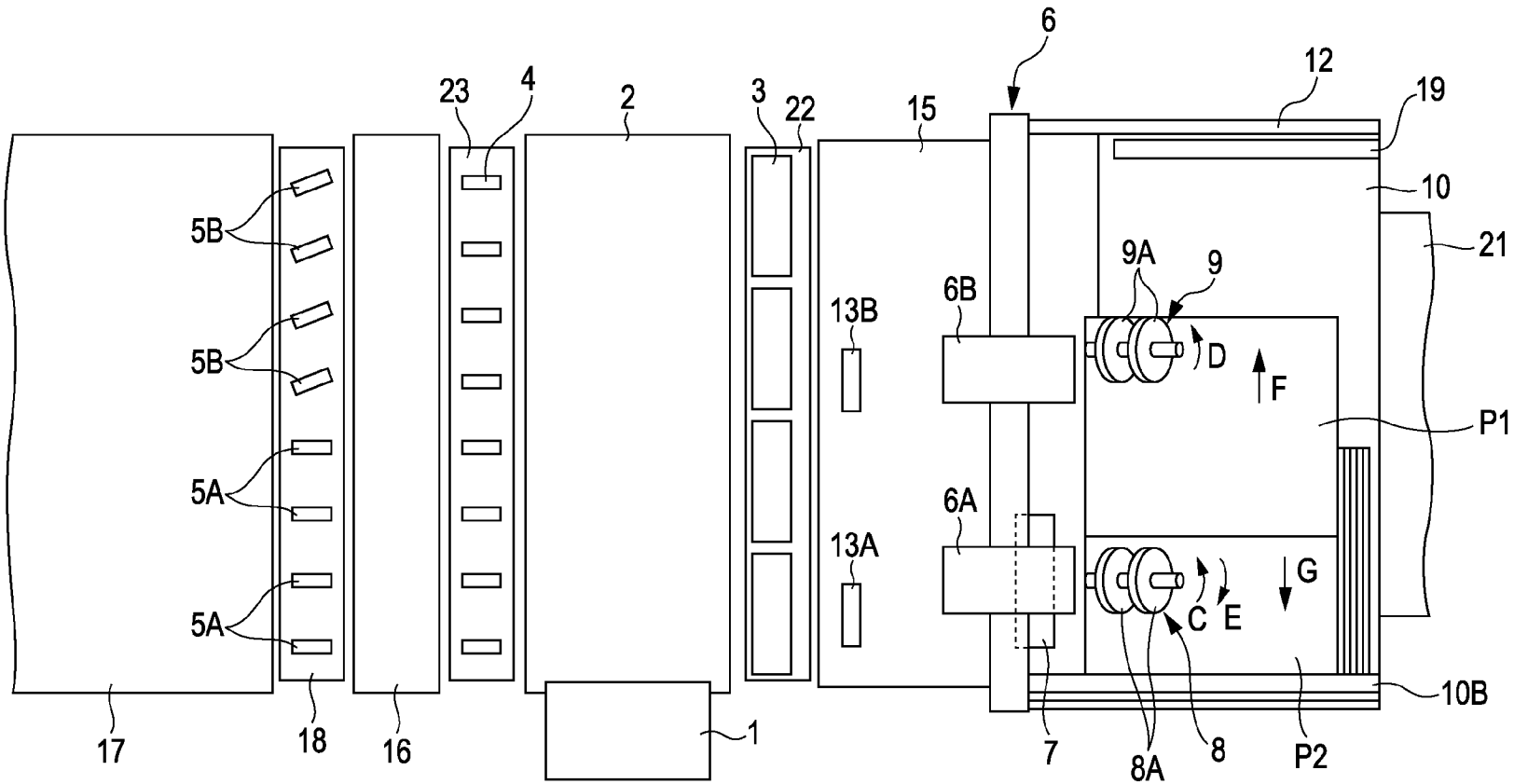
FIG. 5 is a plan view when the topmost sheet on the sheet-stacking portion is moved in a direction intersecting a conveying direction.
Figure 6:
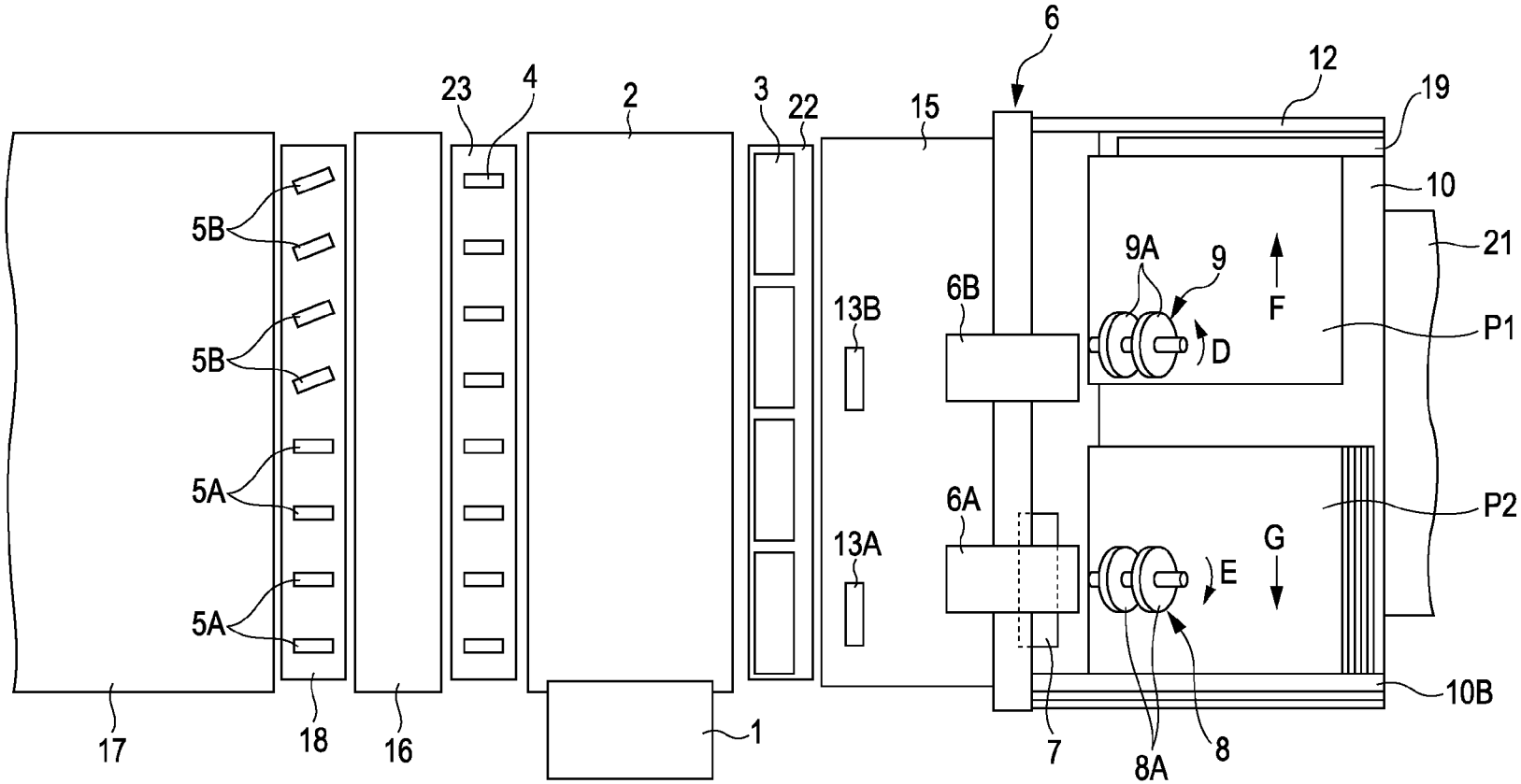
FIG. 6 is a plan view when the topmost sheet on the sheet-stacking portion is shifted to a parallel position.
Figure 7:
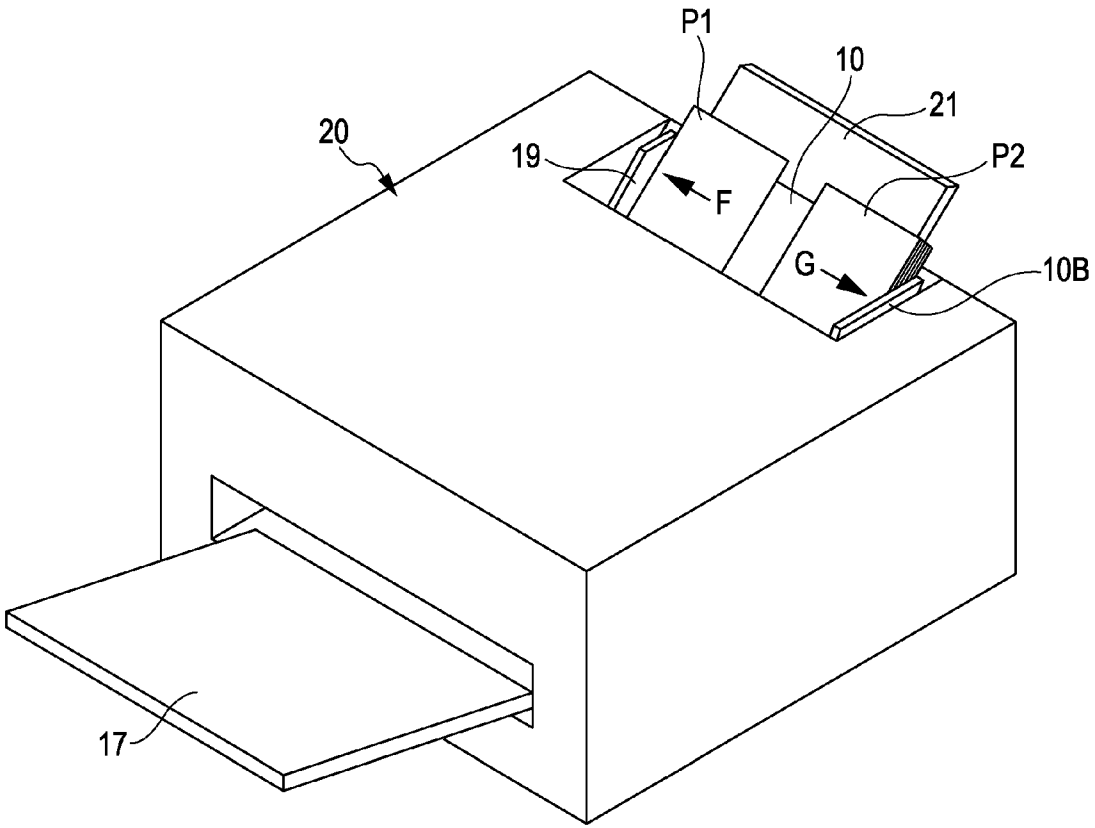
FIG. 7 is a perspective view of the recording apparatus shown in FIG. 6.
Figure 8:
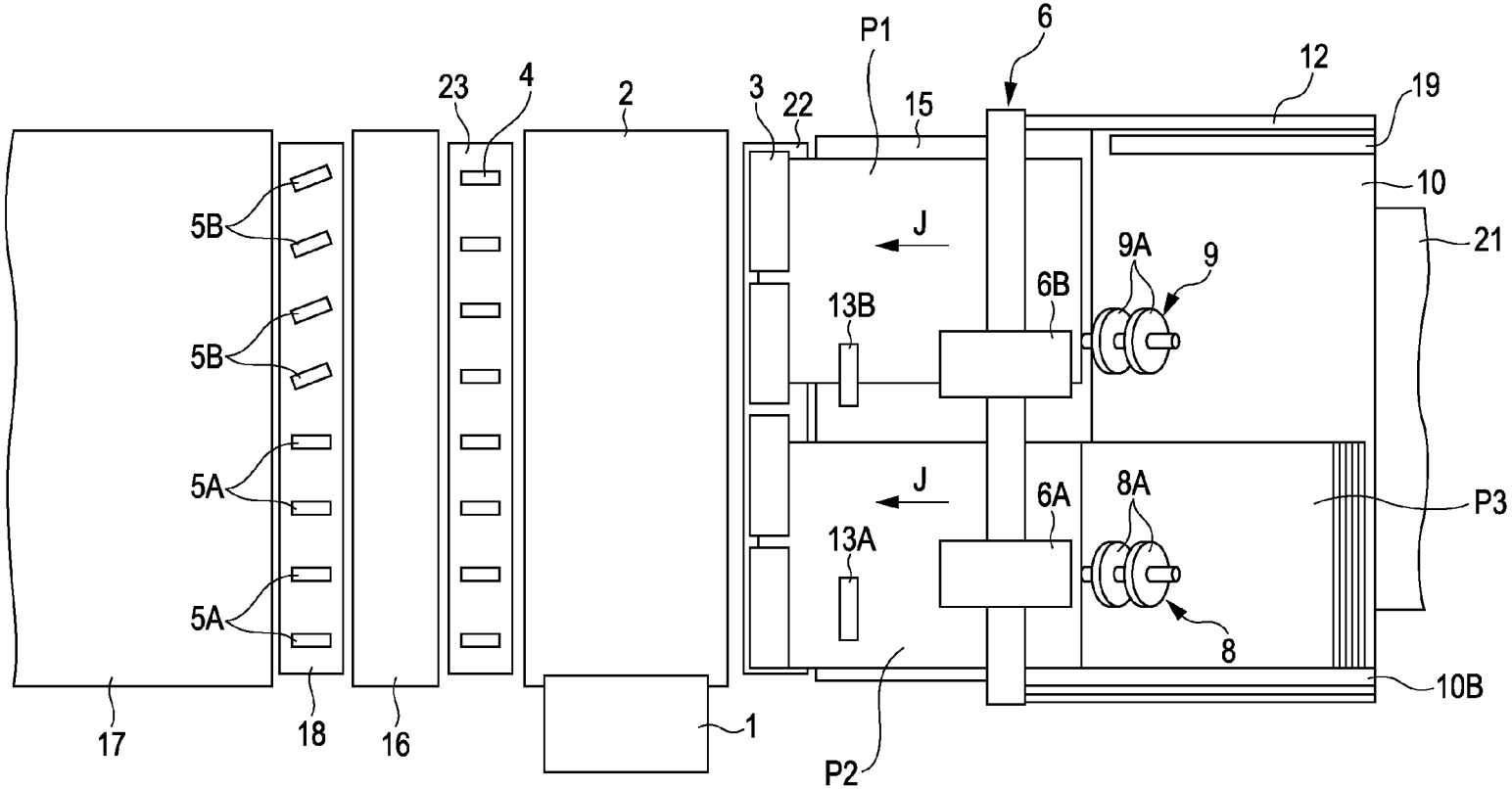
FIG. 8 is a plan view when a sheet at a parallel position and a sheet at a setting position are conveyed by a feeding roller.
Figure 9:
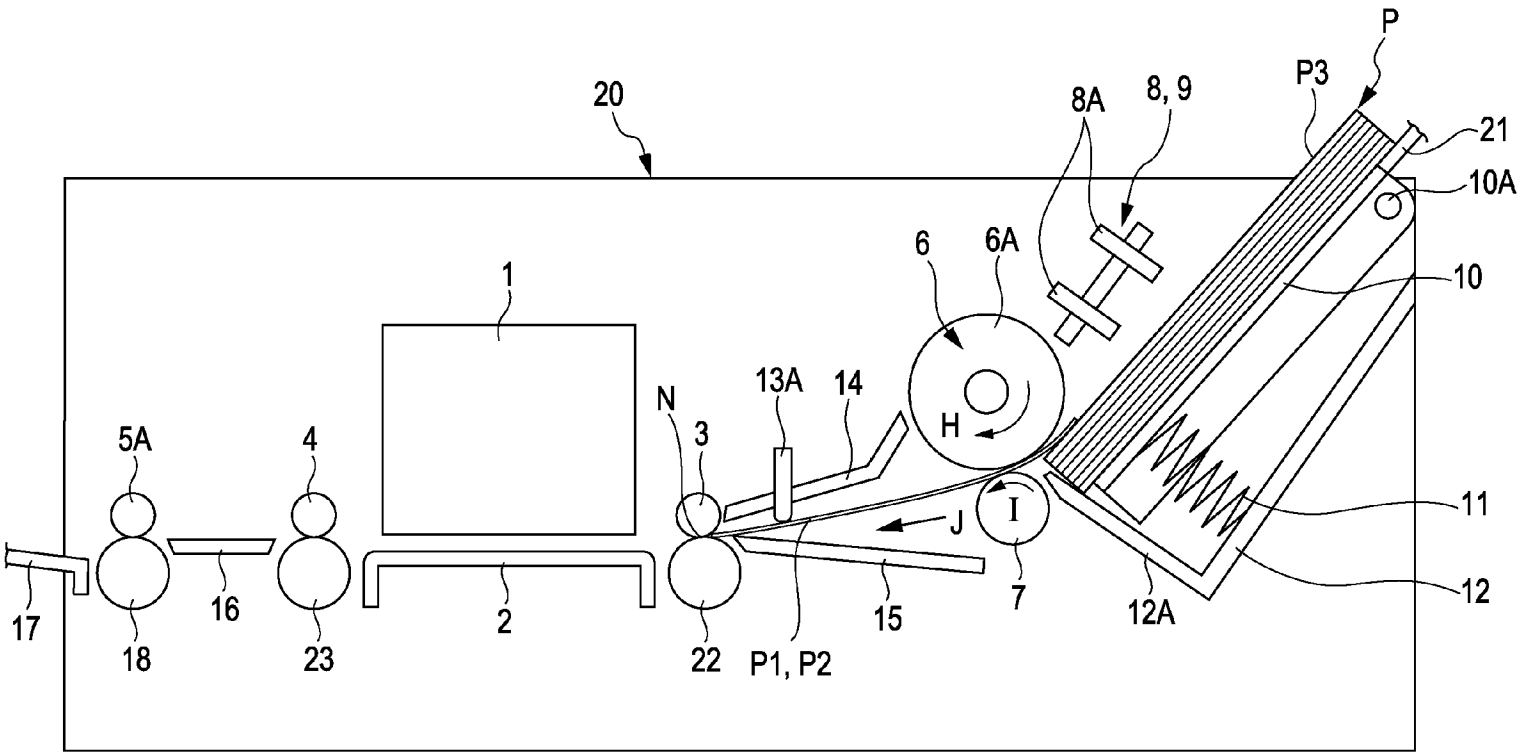
FIG. 9 is a vertical sectional view of the recording apparatus shown in FIG. 8.
Figure 10:
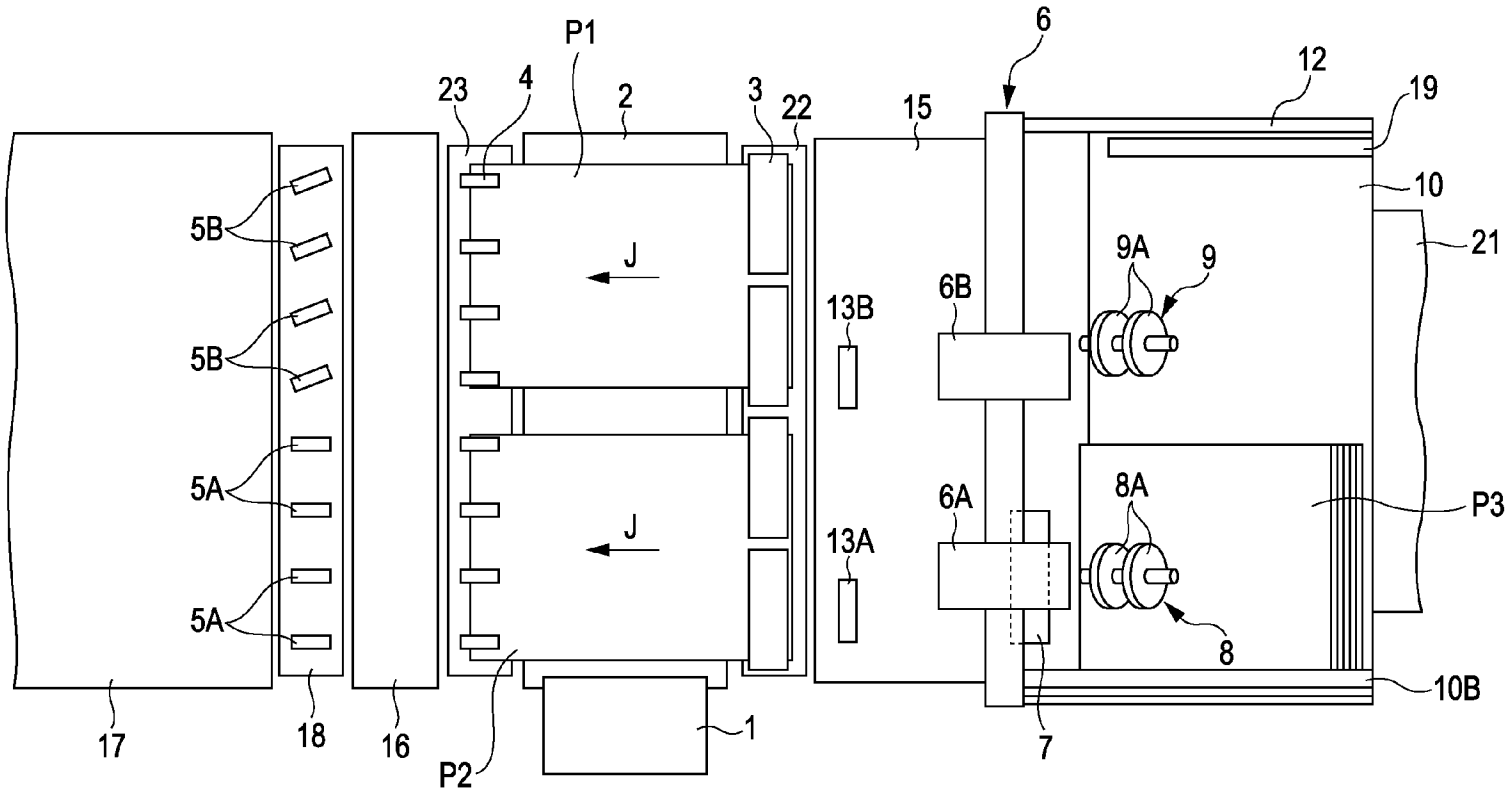
FIG. 10 is a plan view when the sheet at the parallel position side and the sheet at the setting position side are conveyed to a recording portion.
Figure 11:
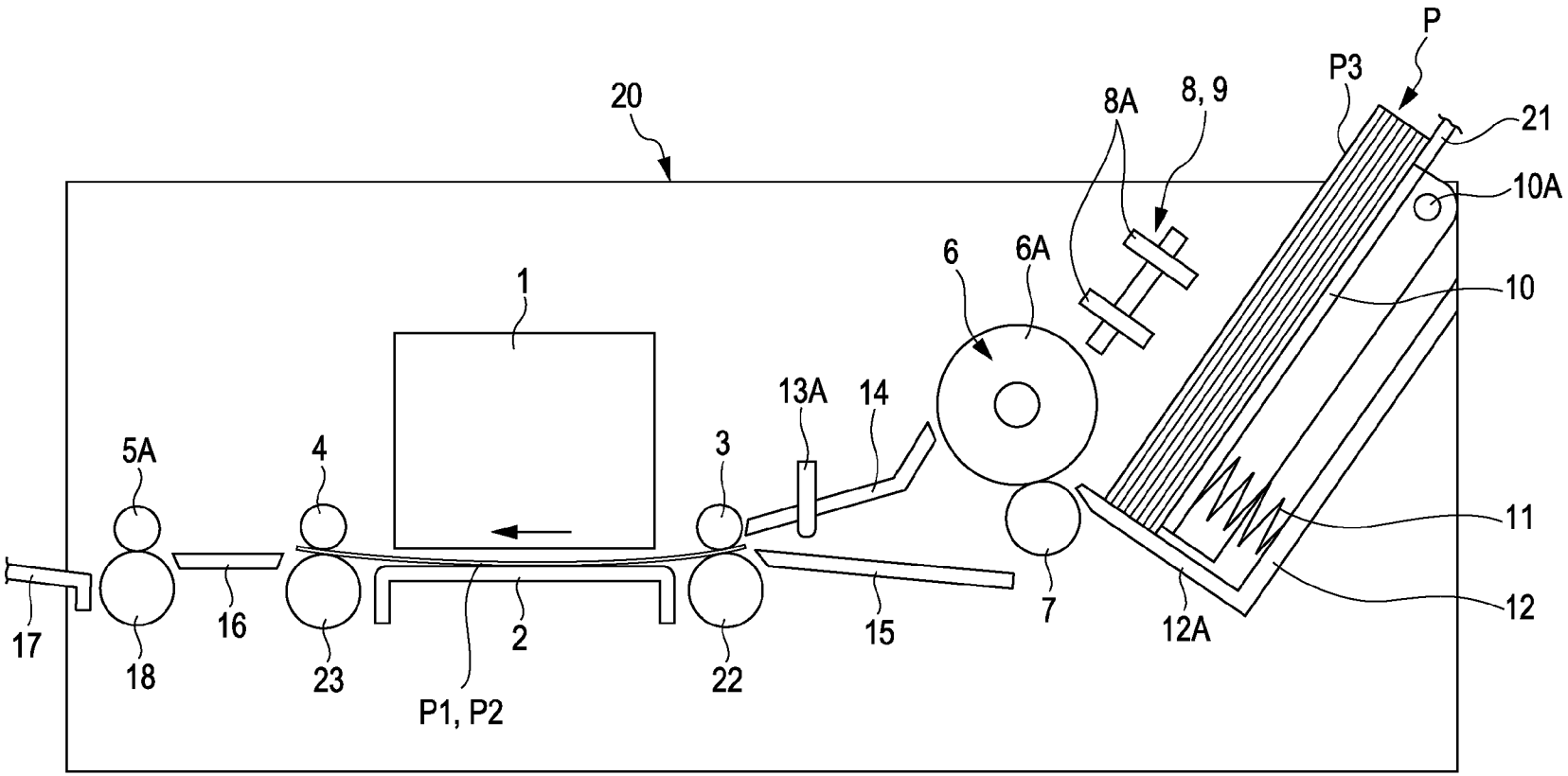
FIG. 11 is a vertical sectional view of the recording apparatus shown in FIG. 10.
Figure 12:
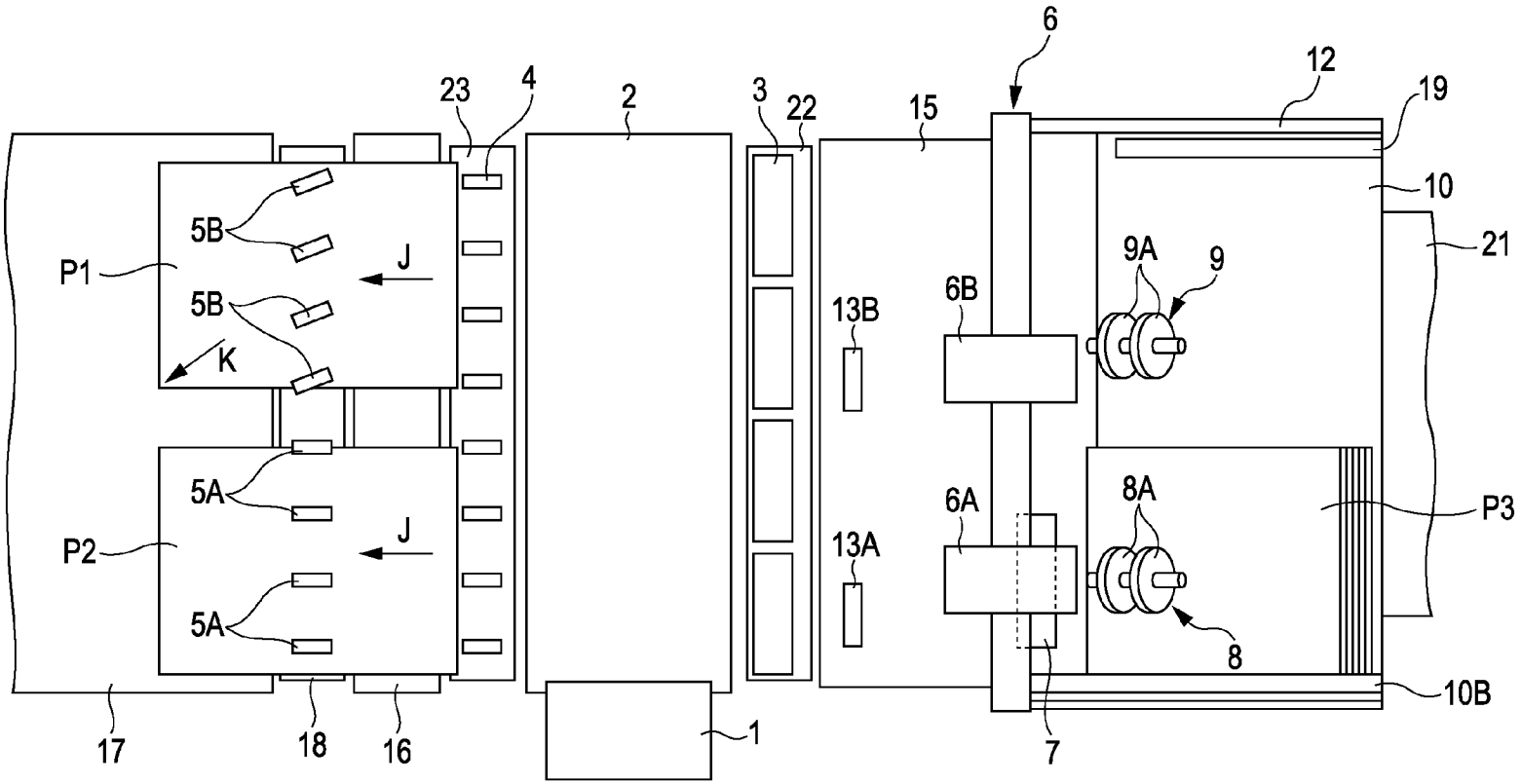
FIG. 12 is a plan view when the sheet at the setting position side and the sheet at the parallel position side are ejected.
Figure 13:
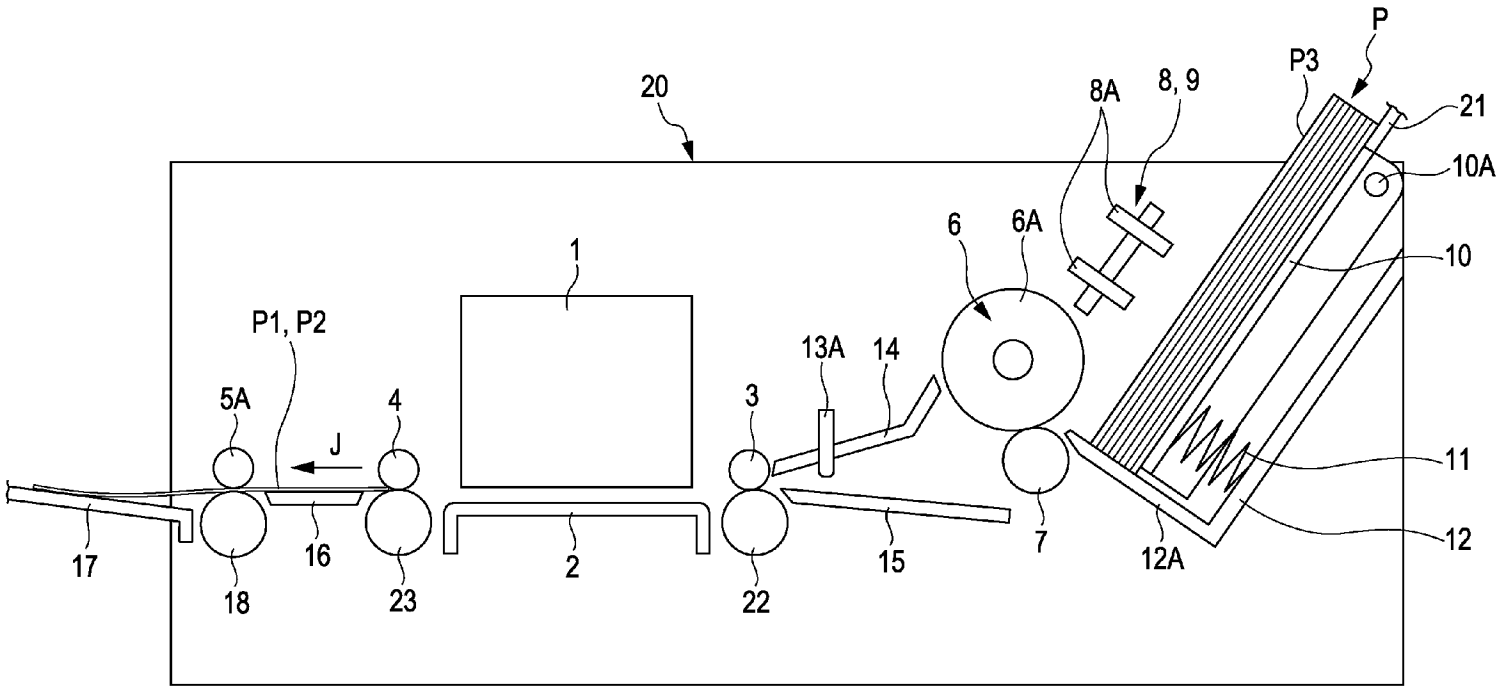
FIG. 13 is a vertical sectional view of the recording apparatus shown in FIG. 12.
Figure 14:
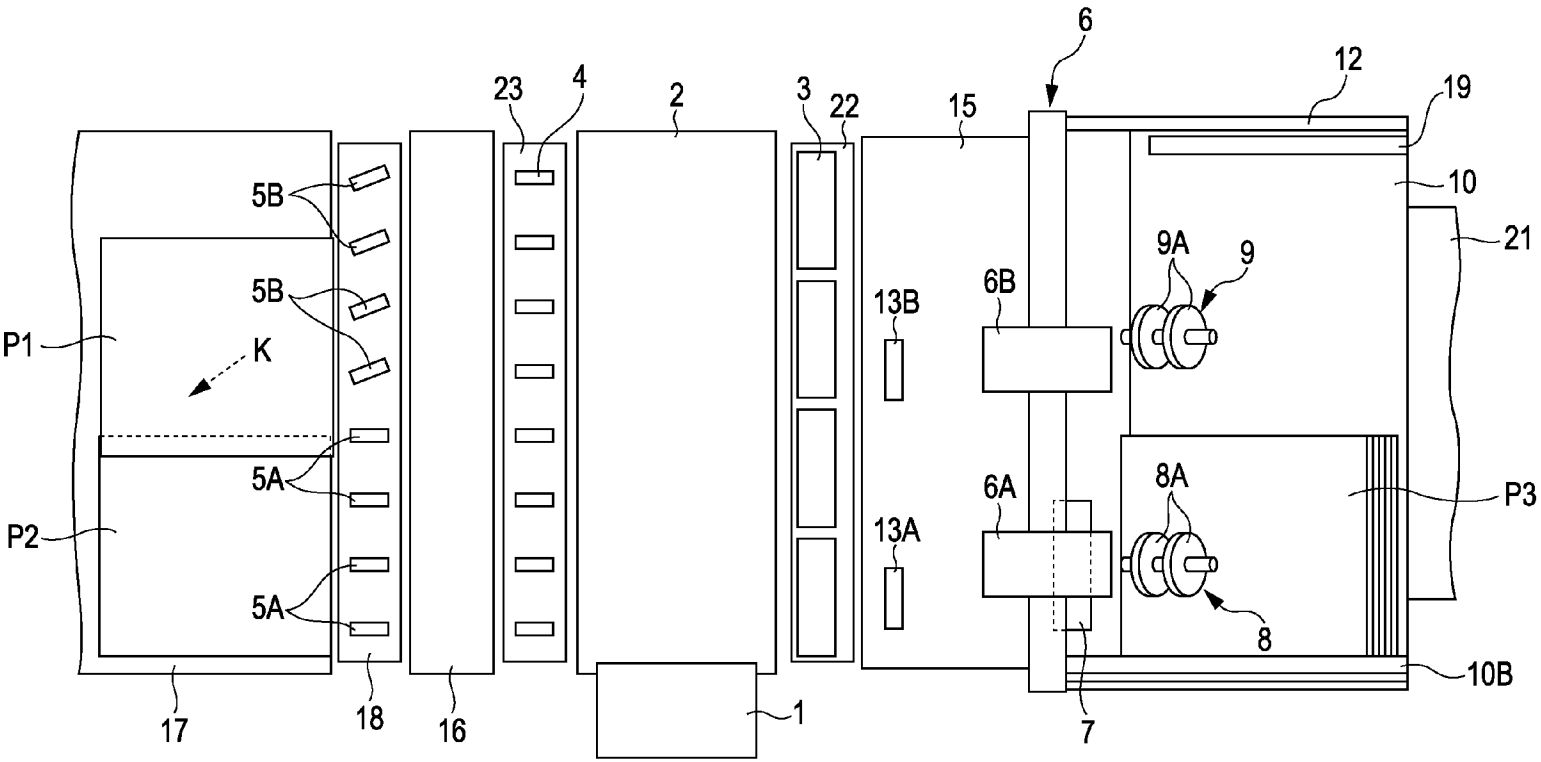
FIG. 14 is a plan view showing a state in which the sheet at the parallel position side and the sheet at the setting position side are overlapped and ejected.
Figure 15:
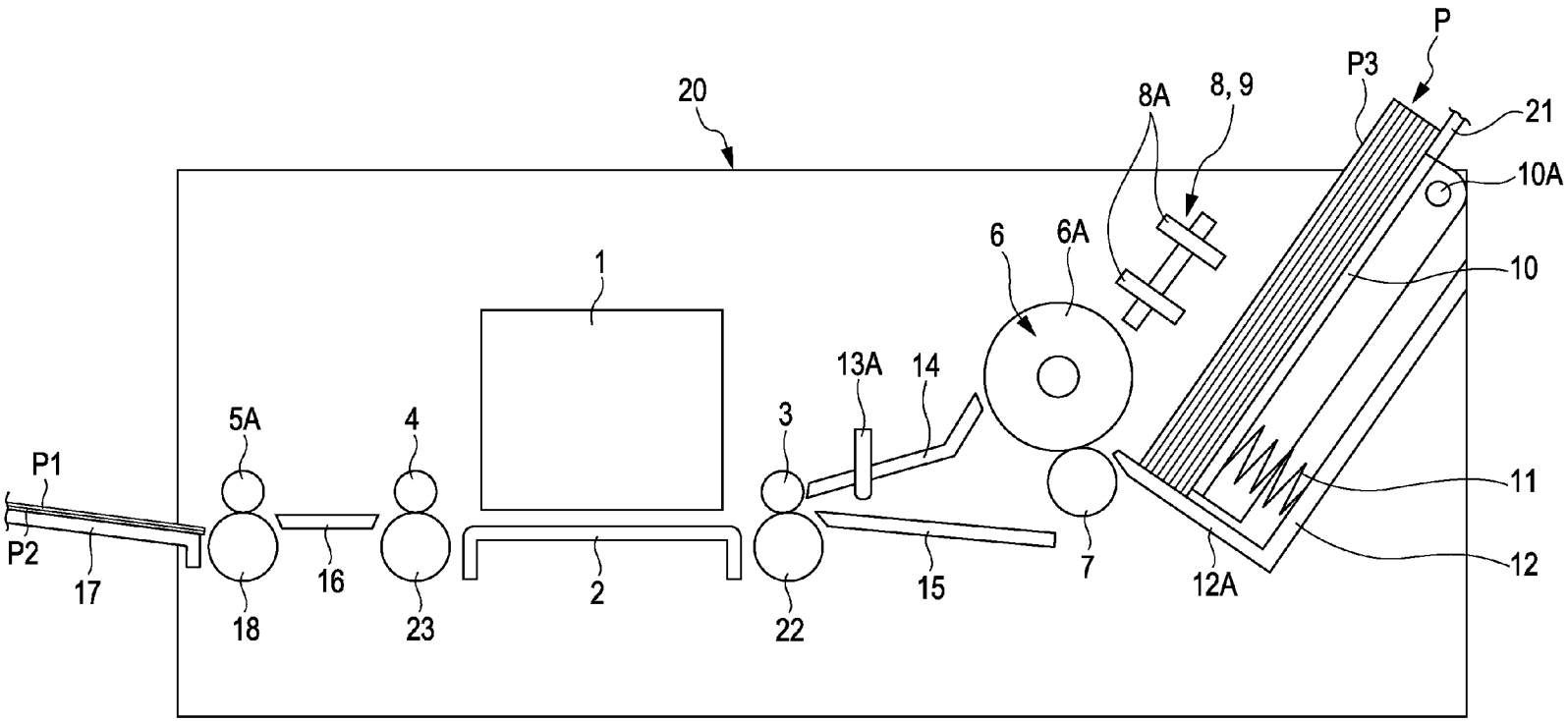
FIG. 15 is a vertical sectional view of the recording apparatus shown in FIG. 14.

FIG. 4 is a vertical sectional view when the moving rollers are pressed against the sheets that are stacked on the sheet-stacking portion. FIG. 5 is a plan view when the topmost sheet on the sheet-stacking portion is moved in the direction intersecting the conveying direction. FIG. 6 is a plan view when the topmost sheet on the sheet-stacking portion is shifted to the parallel position. FIG. 7 is a perspective view of the recording apparatus shown in FIG. 6. FIG. 8 is a plan view when the sheet at the parallel position and the sheet at the setting position are conveyed by the feeding roller. FIG. 9 is a vertical sectional view of the recording apparatus shown in FIG. 8. FIG. 10 is a plan view when the sheet at the parallel position side and the sheet at the setting position side are conveyed to the recording portion. FIG. 11 is a vertical sectional view of the recording apparatus shown in FIG. 10. FIG. 12 is a plan view when the sheet at the setting position side and the sheet at the parallel position side are ejected. FIG. 13 is a vertical sectional view of the recording apparatus shown in FIG. 12. FIG. 14 is a plan view showing a state in which the sheet at the parallel position side and the sheet at the setting position side are overlapped and ejected. FIG. 15 is a vertical sectional view of the recording apparatus shown in FIG. 14.

Next, the structure and the operation of the recording apparatus shown in FIG. 1 will be described. Here, the recording apparatus shown in FIG. 1 performs simultaneous recording of two sheets by stacking the sheets P at the setting position of the sheet stacking portion and by shifting the topmost (first) sheet up to the parallel position in the direction that intersects the conveying direction. As shown in FIG. 2, the first moving roller 8 and the second moving roller 9 are at retreat positions where they are retreated in the direction of arrow B (that is, at positions where they are separated from the sheets in the direction of arrow B). In this state, a user sets the sheets P at the setting position of the pressure plate 10 (serving as the sheet stacking portion) so that the rear edges of the sheets P contact a first width regulating portion 10B. At this time, the pressure plate 10 (serving as the sheet stacking portion) resists the spring 11 by, for example, a control cam, and is separated from the feeding roller 6.

The conveying operation of the sheets will now be described. The first moving roller 8 and the second moving roller 9 are moved in the direction of arrow A shown in FIG. 2, and contacts the sheet P as shown in FIG. 4. Next, as shown in FIG. 1, the first moving roller 8 is rotated in the direction of arrow C, and the second moving roller 9 is rotated in the direction of arrow D, so that the topmost (first) sheet P1 is moved in the direction of arrow F from the setting position. Next, as shown in FIG. 5, after the sheet P1 has passed the first moving roller 8, the second moving roller 9 is rotated in the direction of arrow D to further move the sheet P1 in the direction of arrow F. At this time, the first moving roller 8 is rotated in the reverse direction, that is, in the direction of arrow E, so that a second sheet P2 that has moved due to the moving of the first sheet P1 is returned to its original position in the direction of arrow G. As shown in FIGS. 6 and 7, the rotations of the first moving roller 8 and the second moving roller 9 cause the first sheet P1 to be shifted to the parallel position where the first sheet P1 abuts against a second width regulating portion 19. When the first sheet P1 contacts the second width regulating portion 19, the first sheet P1 is positioned in the widthwise direction. When the second sheet P2 contacts the first regulating portion 10B, the second sheet P2 is positioned in the widthwise direction. The parallel position at which the first sheet P1 is positioned is separated from the second sheet at the setting position by a predetermined interval in the widthwise direction. The first width regulating portion 10B is fixed, and the second width regulating portion 19 is movable in the widthwise direction of the sheet.

With reference to FIGS. 8 and 9, the conveyance of the first sheet P1 and the conveyance of the second sheet P2 will now be described. After the first sheet P1 and the second sheet P2 have been positioned in the widthwise direction, the cam (for the pressure plate 10) that is separated from the feeding roller 6 is rotated to press-contact the sheets P1 and P2 against the feeding roller 6. Then, the feeding roller 6 is rotated in the direction of arrow H. This causes the second sheet P2 at the setting position to be separated from a third sheet P3 by the first roller portion 6A and the separating roller 7, so that only the second sheet P2 is conveyed in the direction of arrow J. The first sheet P1 at the parallel position is conveyed in the direction of arrow J by the second roller portion 6B. The sheets P1 and P2 are conveyed towards the feeding roller 22 through the sheet guides 14 and 15. When the front edge of the sheet P1 and the front edge of the sheet P2 are detected by the sheet edge sensor 13B and the sheet edge sensor 13A, a registration operation is performed for aligning the front edges of the sheets P1 and P2 on the basis of position information thereof. That is, the front edges of the sheets P1 and P2 are abutted against the nip portion N between the stopped pinch roller 3 and the stopped feeding roller 22, and are conveyed by only a predetermined amount to form loops. The registration can also be performed by abutting the sheets P1 and P2 against the nip portion N between the pinch roller 3 and the feeding roller 22 that are rotating in reverse directions.

Next, as shown in FIGS. 10 and 11, the rotation of the feeding roller 22 is started to convey the sheets P1 and P2 through the recording portion, so that the simultaneous recording is performed by the recording head 1. The carriage (not shown) carrying the recording head 1 is caused to reciprocate in the widthwise direction of the sheet, to form an image one line at a time. In the embodiment, the first eject roller 23 and the second eject roller 18 are also rotationally driven in synchronism with the feeding roller 22. The sheets are conveyed to the recording portion by the feeding roller 22 and the first eject roller 23. Next, as shown in FIGS. 12 and 13, the recording of the sheets P1 and P2 is ended, and the sheets P1 and P2 are conveyed in the direction of arrow J until the rear edges of the respective sheets P1 and P2 pass through a nip portion between the first eject roller 23 and a spur 4. When the rear edges of the sheets P1 and P2 have passed through the nip portion between the first eject roller 23 and the spur 4, the second sheet P2 that is conveyed along the setting position side is ejected in the direction of arrow J by the second eject roller 18 and the spur 5A. In contrast, the first sheet P1 that is conveyed along the parallel position side is obliquely ejected in the direction of arrow K by the obliquely disposed spur 5B.

When the conveyance of the sheets progresses, the first sheet P1 at the parallel position side is conveyed up to a position where the first sheet P1 overlaps the second sheet P2 at the setting position side. As shown in FIGS. 14 and 15, the sheets P1 and P2 are finally ejected onto the eject tray 17 with a portion of the first sheet P1 overlapping the second sheet P2. In the simultaneous recording in the embodiment, considering a stacking order of the sheets that are ejected, the content of the first page is recorded on the second sheet P2, and the content of the second page is recorded on the first sheet P1. The obliquely feeding roller for obliquely conveying the sheets P may be formed so that the second eject roller 18 is divided and the divided portion thereof at the parallel position side is tilted, or both divided portions of the eject roller are tilted.

When such simultaneous recording is sequentially performed, the passages of the rear edges of the sheets P1 and P2 are detected by the sensors 13B and 13A, and the above-described operations are repeated on the next two sheets on the basis of position information thereof. That is, while a next sheet P3 is shifted to the parallel position by the moving rollers 8 and 9, the sheet P3 and a sheet P4 are fed. This makes it possible to sequentially perform the simultaneous recording. Such simultaneous recording makes it possible to increase recording speed and reduce recording time. Since the second sheet P2 is caused to overlap the recorded first sheet P1, even if the simultaneous recording is performed on many sheets, it is not necessary to rearrange the order of the recorded sheets P, thereby making it possible to increase operability.

Figure 16:
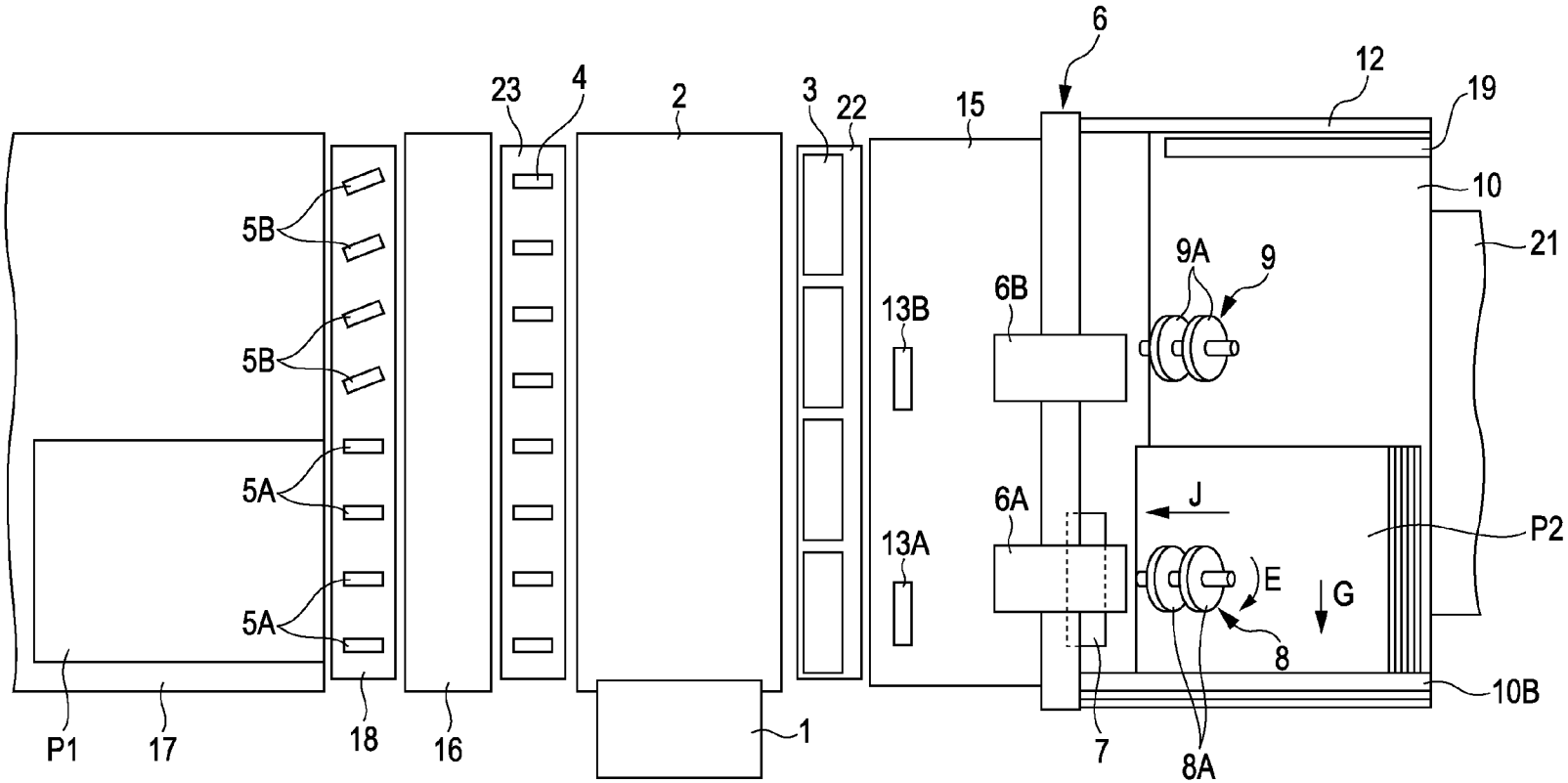
FIG. 16 is a plan view when only the sheet at the setting position side is conveyed, recorded, and ejected.

FIG. 16 is a plan view when only the sheet at the setting position side is conveyed, recorded, and ejected. While the sheets are set on the pressure plate 10, the sheets can be subjected to recording one sheet at a time by an ordinary conveying operation without moving them in the widthwise direction. In this case, the first width regulating portion 10B regulates a widthwise-direction position of a standard side edge of the set sheet P to convey the sheet P by the first roller portion 6A and the separating roller 7, so that the recording portion performs the recording operation on the sheet P. At this time, the second width regulating portion 19 is at the same position as that when simultaneous recording is performed. The sheet P is positioned in the widthwise direction by moving the sheet P in the direction of arrow G as a result of reverse-rotating the first moving roller 8 in the direction of arrow E prior to the conveying operation, and by abutting the sheet against the first width regulating portion 10B. Accordingly, while the second width regulating portion 19 is at the same position as that when simultaneous recording is performed, the above-described simultaneous recording and the recording of one sheet that is set at one position can be selectively executed. That is, a simultaneous recording mode, in which simultaneous recording of two sheets is performed, and an ordinary recording mode, in which sheets are conveyed one at a time, can be selectively executed.

Figure 17:
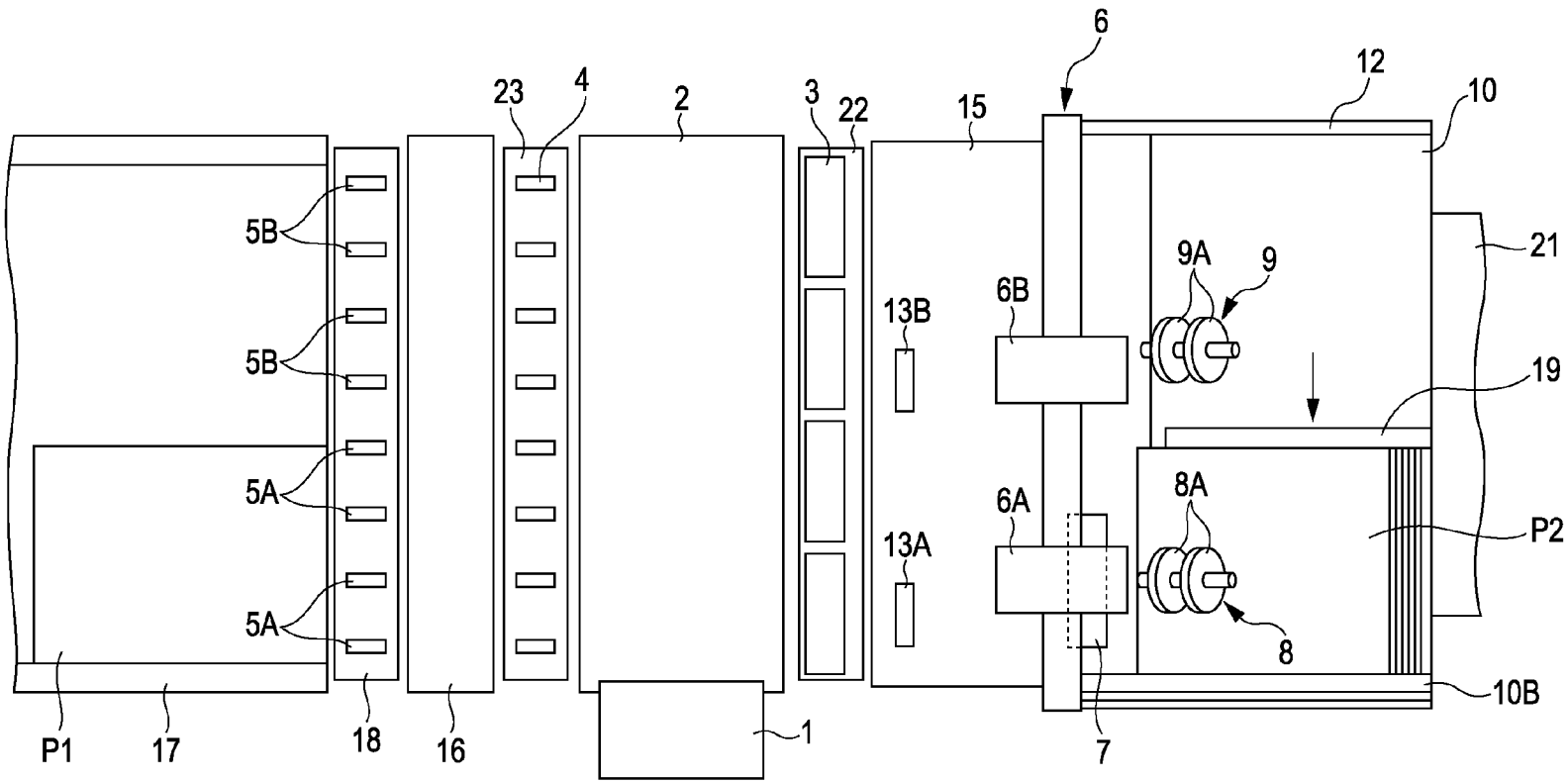
FIG. 17 is a plan view when both edges of the sheet at the setting position side are regulated, and only the sheet at the setting position side is conveyed, recorded, and ejected.
Figure 18:
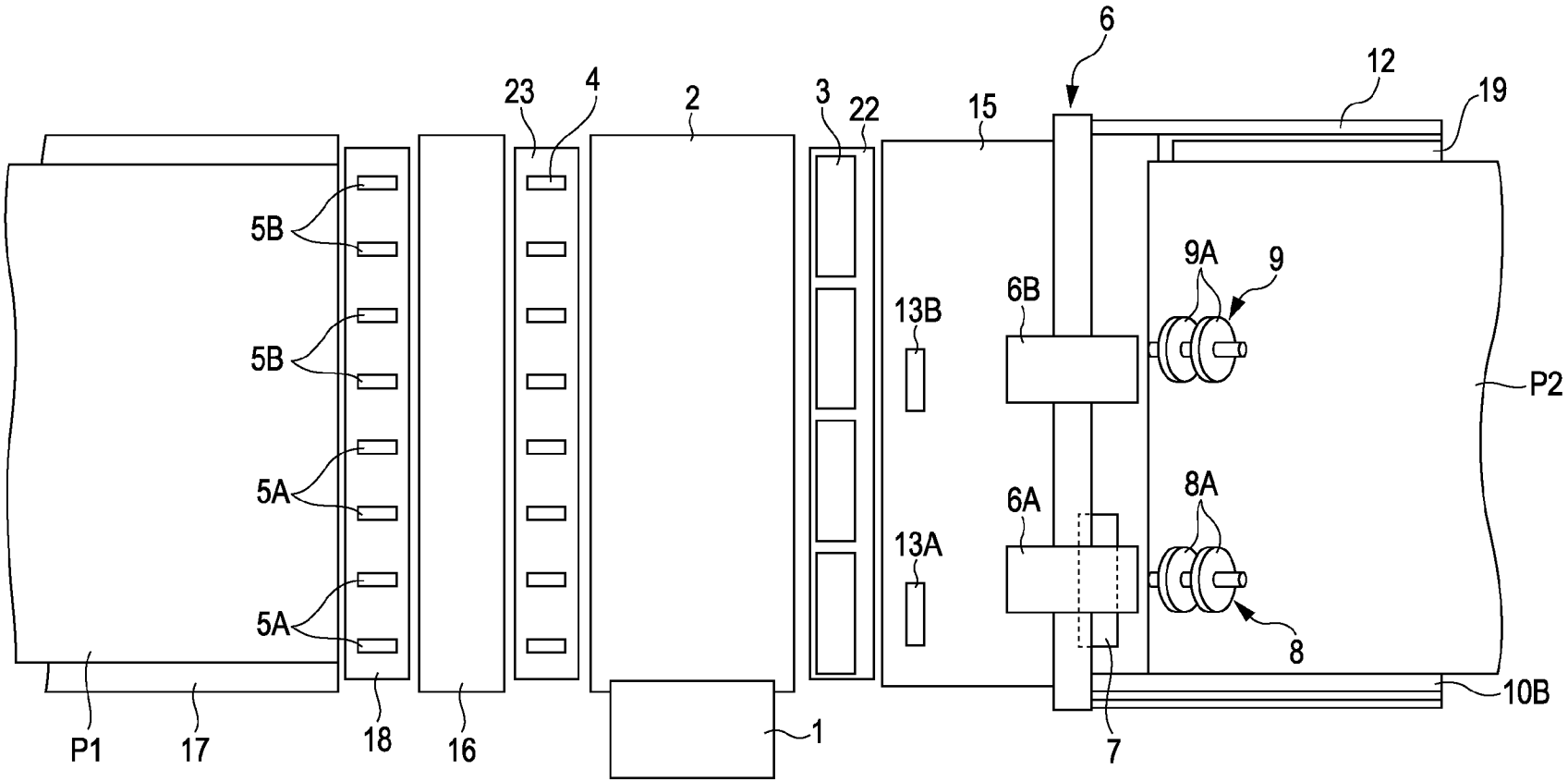
FIG. 18 is a plan view when a wide sheet is conveyed, recorded, and ejected.

FIG. 17 is a plan view when both edges of the sheet at the setting position side are regulated, and only the sheet at the setting position side is conveyed, recorded, and ejected. FIG. 18 is a plan view when a wide sheet is conveyed, recorded, and ejected. In the recording apparatus according to the embodiment, while the second width regulating portion 19 is set at the position shown in FIG. 1, ordinary recording of one sheet can be performed. It is possible to perform the ordinary recording of one sheet by moving the second width regulating portion 19 to the position shown in FIG. 17. According to such a structure, the sheet when one sheet is conveyed can be reliably positioned in the widthwise direction of the sheet. Similarly, as shown in FIG. 18, it possible to similarly perform the ordinary one-sheet recording on a large sheet P by setting it on the sheet stacking portion 10, and by moving the second width regulating portion 19 in the widthwise direction of the sheet to position the sheet in the widthwise direction. Accordingly, the structures for positioning the sheet in the widthwise direction when the sheet is set for the simultaneous recording and when the sheet is set for the ordinary one-sheet recording can be made common by a simple structure.

Although the recording apparatus according to the embodiment is formed so as to obliquely convey a sheet at the parallel position side by the obliquely disposed spurs 5B, the recording apparatus can be formed so as to selectively convey the sheet obliquely or in a straight line. For example, the recording apparatus may be formed so that the sheet is selectively conveyed obliquely or in a straight line as a result of switching the angle of the obliquely disposed spurs 5B. According to this structure, in simultaneous recording, an alternate ejection mode, such as that mentioned above, and a parallel ejection mode, in which sheets are ejected in parallel, can be selectively executed.

Second Exemplary Embodiment

Figure 19:
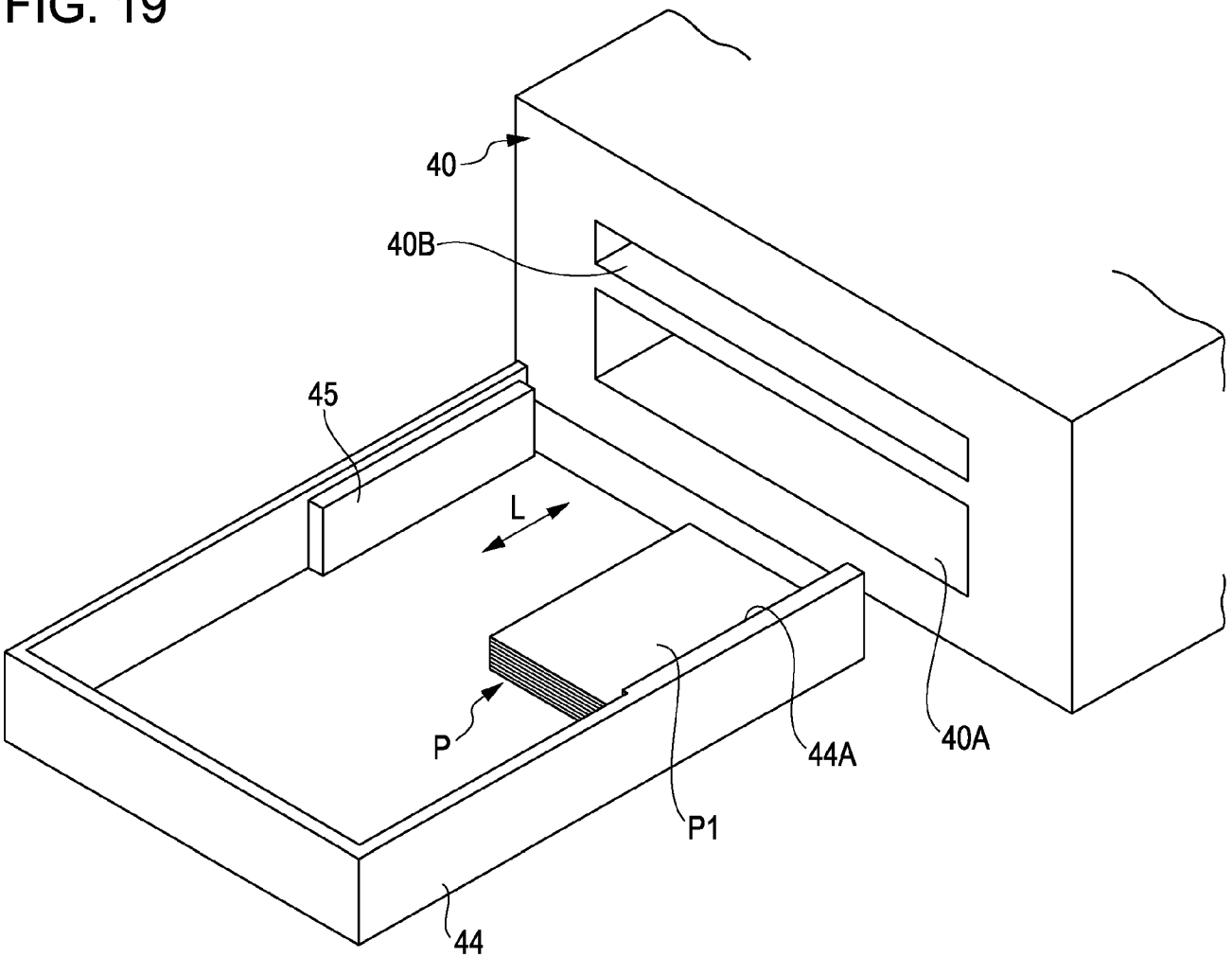
FIG. 19 is a perspective view of a recording apparatus that conveys sheets as a result of being placed behind the apparatus from the bottom surface of the main body of the apparatus.

FIG. 19 is a perspective view of a recording apparatus that conveys sheets by being placed behind the apparatus from the bottom surface of the main body of the apparatus. In FIG. 19, reference numeral 44 denotes a sheet-feeding cassette that can be mounted to and removed from an opening 40A of a main body 40 of the apparatus in the directions of double-headed arrow L. The sheet-feeding cassette 44 includes a first width regulating portion 44A and a second width regulating portion 45. The first width regulating portion 44A comes into contact with a reference side edge of a set sheet P, and regulates the position of the reference side edge of the set sheet P in the widthwise direction. The second width regulating portion 45 is a movable regulating portion that is disposed opposite to the first width regulating portion 44A. The first width regulating portion 44 corresponds to the first width regulating portion 10B in the first embodiment, and the second width regulating portion 45 corresponds to the second width regulating portion 19 in the first embodiment. The sheet P is conveyed so as to make a U turn at the back portion in the main body 40 of the apparatus, so that recording is performed on the sheet having its front and back reversed. Then, the recorded sheet is ejected from the opening 40B in the front of the apparatus. The other structural features are the same as those of the first embodiment.

The above-described embodiments make it possible to prevent a user from going through the trouble of setting the sheets at two different locations when the user sets the sheets for performing simultaneous recording of the two sheets. Therefore, it is possible to prevent imprecise and unstable setting of the sheets resulting from setting the sheets at two separate locations as in the related examples. In addition, since the sheets are set at one location of the sheet stacking portion, it is possible to increase recording speed, to reduce recording time, and to increase operability during simultaneous recording. Further, since, in the simultaneous recording, the sheets are set at one position, controlling of the order of the sheets and controlling of the feeding operation when there are no sheets can be simplified. In simultaneous recording, the ejected sheets are caused to overlap each other, so that the ejected sheets are automatically placed upon each other in the recording order. Therefore, the sheets are stacked upon each other in accordance with page order. Therefore, the user can be prevented from going through the trouble of, for example, alternately rearranging the order of pages of the stacked sheets after they are ejected.

Although, in the above-described embodiments, a serial recording apparatus that performs a recording operation by moving the recording head 1 in the widthwise direction of the sheet P is used, the invention is similarly applicable to a line recording apparatus that performs a recording operation only by sub scanning in the sheet conveying direction. In addition, the present invention is not limited to a stand-alone recording apparatus, such as a printer, a copying machine, a fax machine, or a pickup image forming apparatus. Therefore, the present invention is widely applicable to a composite apparatus which is a combination of any of these stand-alone recording apparatuses, or to a recording apparatus in a composite apparatus such as a computer system. Any material having any property, such as paper, plastic sheets, photographic contrast paper, cloth, or overhead projector (OHP) sheets, may be used for the sheets P as long as an image can be recorded on the material.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-118064 filed Apr. 27, 2007, which is hereby incorporated by reference herein in its entirety.

What is claimed is:

1. A recording apparatus that performs recording operations on sheets with a recording head, the recording apparatus comprising:

a sheet stacking portion having a setting position where the sheets are stacked;

a moving roller configured to move a first sheet of the sheets stacked at the setting position, in a direction intersecting with a conveying direction; and a feeding roller configured to convey the sheets at the sheet stacking portion, wherein, after the moving roller moves the first sheet stacked at the setting position to a parallel position, the feeding roller conveys the first sheet at the parallel position and a second sheet of the sheets at the setting position, the parallel position being set in the direction intersecting with the conveying direction.

2. The recording apparatus according to claim 1, wherein the moving roller includes a first moving roller and a second moving roller, the first moving roller sending out the sheets stacked at the setting position, the second moving roller shifting the sent-out sheets up to the parallel position.

3. The recording apparatus according to claim 2, further comprising:

a first regulating portion configured to regulate positions in a widthwise direction of the sheets stacked at the setting position; and a second regulating portion configured to regulate a position in the widthwise direction of the sheet at the parallel position, wherein the second moving roller presses the first sheet against the second regulating portion, and the first moving roller is reversely rotated to press the second sheet against the first regulating portion.

4. The recording apparatus according to claim 1, further comprising a sensor configured to detect the sheets conveyed by the feeding roller, wherein after the sensor detects rear edges of the sheets, the sheet stacked at the setting position starts to move.

5. The recording apparatus according to claim 1, further comprising a simultaneous recording mode and an ordinary recording mode that can be selected for allowing a controlling operation, wherein, in the simultaneous recording mode, the feeding roller conveys the first sheet at the parallel position and the second sheet at the setting position to perform the recording operations by the recording head, and wherein, in the ordinary recording mode, the feeding roller conveys only the sheet stacked at the setting position to perform the recording operation by the recording head.

6. The recording apparatus according to claim 5, wherein, in the ordinary recording mode, a widthwise-direction position at the parallel position side of the sheet at the setting position is regulated by the second regulating portion.

7. The recording apparatus according to claim 1, further comprising an eject roller ejecting the sheets on which the recording operations are performed by the recording head, wherein the eject roller includes an obliquely feeding roller that causes the sheet conveyed from the parallel position and subjected to the recording operation by the recording head to overlap the sheet conveyed from the setting position and subjected to the recording operation by the recording head.

8. The recording apparatus according to claim 7, wherein the obliquely feeding roller is configured to switch between a state in which the sheets are obliquely conveyed and a state in which the sheets are conveyed in straight lines.

9. The recording apparatus according to claim 8, further comprising an alternate eject mode and a parallel eject mode that can be selected for allowing a controlling operation, wherein, in the alternate eject mode, with the obliquely feeding roller being set in the state in which the obliquely feeding roller obliquely conveys the sheets, the sheet conveyed from the parallel position and subjected to the recording operation by the recording head and the sheet conveyed from the setting position and subjected to the recording operation by the recording head are overlapped and discharged, and wherein, in the parallel eject mode, with the obliquely feeding roller being set in the state in which the obliquely feeding roller conveys the sheets in straight lines, the sheet conveyed from the parallel position and subjected to the recording operation by the recording head and the sheet conveyed from the setting position and subjected to the recording operation by the recording head are ejected in parallel.

* * * * *